US006027066A

United States Patent [19]

Street

[11] Patent Number: 6,027,066

[45] Date of Patent: Feb. 22, 2000

[54] CARPET STRIP ROLLING MACHINE

[76] Inventor: Gayle B. Street, 2488 W. 7325 South, West Jordan, Utah 84084

[21] Appl. No.: 08/795,653

[22] Filed: Feb. 6, 1997

[51] Int. Cl.[7] ..... B65H 19/28; B65H 19/22; B65H 18/10; D05B 23/00

[52] U.S. Cl. ..... 242/532.5; 242/532.6; 242/533.8; 242/535; 242/538.2; 242/539; 242/546; 242/578.2; 242/587.2; 112/7

[58] Field of Search ..... 242/545, 545.1, 242/532.6, 535, 539, 546, 533.8, 578.2, 578, 597.4, 587.2, 579, 532.5, 538.2; 112/7, 137, 152

[56] References Cited

U.S. PATENT DOCUMENTS

| | | | |
|---|---|---|---|
| 1,159,781 | 11/1915 | McCoy . | |
| 2,493,893 | 1/1950 | Miller . | |
| 2,788,180 | 4/1957 | Houska et al. . | |
| 3,319,906 | 5/1967 | Atkinson . | |
| 3,653,602 | 4/1972 | Harrington . | |
| 3,664,594 | 5/1972 | Novak . | |
| 4,120,463 | 10/1978 | Alinder et al. . | |
| 4,160,528 | 7/1979 | Malone, Sr. et al. . | |
| 4,198,010 | 4/1980 | Knapp . | |
| 4,394,052 | 7/1983 | Adams et al. | 299/18 |
| 5,370,326 | 12/1994 | Webb . | |

*Primary Examiner*—Donald P. Walsh
*Assistant Examiner*—William A. Rivera
*Attorney, Agent, or Firm*—Mallinckrodt & Mallinckrodt

[57] ABSTRACT

A device for winding a carpet strip into a compact roll for handling and transport winds the carpet strip about a motor powered winding spindle controlled by, for example, a foot pedal, the strip being guided onto the spindle by a pair of selectively spaced apart guiding discs. The rolling machine may be attached to the frame of a sewing station through which the strip is passed to provide a binding tape along an edge of the carpet strip, the strip passing without handling from the sewing machine to the carpet strip rolling machine. Pedal or other controls at the sewing machine permit the operator to control both the rolling device and the sewing machine from this single location.

22 Claims, 5 Drawing Sheets

CARPET STRIP ROLLING MACHINE

BACKGROUND OF THE INVENTION

1. Field

The field of the invention is devices for winding strips of material into rolls for storage or transportation.

2. State of the Art

A relatively recent development in floor covering embraces the use of a base strip of carpet material secured to the bottom of a wall in place of the more traditional base board adjacent the carpet on the floor. Strips of carpet are cut from larger pieces, and the upper edges subsequently covered by narrow fabric strips or the like commonly referred to as binding tape sewn thereover. Generally the carpet strips, which are usually either four inches, six inches, or eight inches in width, are cut from full rolls of carpet to form strips between fifty and one-hundred-fifty feet in length. The carpet is unrolled in order to cut the strips. The strips must then be either packed to move to a sewing machine for application of the binding tape, after which they again must be packed for transportation to the job site. Sometimes the binding tape is applied at the site where the carpet is cut to avoid one packing step. In many cases the carpet strips are rolled by hand into rolls. This procedure is time-consuming and awkward. However, if the strips are not rolled, the strips tend to become jumbled and tangled, particularly if forcibly jammed into bags or boxes for transport to sewing or job sites. The subsequent untangling of the strips is time consuming and expensive, and undesirable folds and wrinkles may have developed. The sewn-in-place binding tape covers of the upper edges of the base strips to conceal severed fibers and pile and prevent unraveling of such fibers and piles. The strips must be passed through a sewing machine to fold and attach this binding tape in place. After this, the lengths of carpet stripping must still be transported to distant job sites so that tangling and the like can still occur. This double handling of the carpet base strip where the carpet may be manually rolled up twice is, of course, expensive and time-consuming.

While various machines are available for rolling strip material or other elongate items, such as, for example, flattened fire hose, none is capable of easily rolling carpet base strips.

SUMMARY OF THE INVENTION

The invention provides a device for rolling carpet base strips into compact easy to handle and transport rolls. The rolling device comprises a frame mounted spindle rotated by an electric motor which provides rotary power through a belt and pulley arrangement. The power may be transferred from the motor, according to a preferred embodiment, through a clutch, the operation of which is controlled by the operator by a foot pedal mounted on the spindle carrying frame.

A pair of spaced apart discs each extending perpendicularly to the spindle guide the strip onto the roll. One guiding disc is mounted fixedly upon the frame, while the other is utilized in selectable positions along the spindle to provide required space for various widths of carpet base strips. The spindle mounted disc is removed to allow the completed roll to be taken off the spindle. The spindle mounted disc may be retained in selected position during operation of the device by a collar slidable about and along the spindle and secured in selected position against both rotation about and longitudinal movement. Attachment of the free starting end of the carpet strip is greatly facilitated by one or more locking rods, secured as by welding to the collar, extending parallel to and radially spaced away from the surface of the winding spindle. To attach the starting end of the strip, a short end length of strip is inserted through the space between one of the rods and the spindle, preferably in such direction so that spindle rotation folds the strip reversely about the rod to firmly secure the starting end of the strip. After rolling is completed, the roll is tied by a circumferential band, tape, or the like. The outer guiding disc and the slidable collar with locking rods are removed from the spindle and the completed roll, freed of the locking rods, is easily removed from the device.

According to another aspect of the invention, the carpet base strip rolling machine is rigidly affixed to the frame of a sewing machine which folds and sews a strip of binding tape about one edge of the strip, rendering the strip suitable for immediate installation at the base of a building wall. Carpet strip with binding tape sewed thereto moves directly from the sewing machine to the rolling device. In this embodiment of the invention, a foot pedal for control of the spindle rotation is preferably provided at the edge strip sewing machine, so that a single operator may control both the sewing and the rolling machines. The pivotal foot pedal mounted upon the sewing machine frame communicates by pulley and cables to control the aforementioned spindle motor clutch.

It is therefore the principal object of the invention to provide a device to efficiently wind carpet base strips into rolls for easy handling and transport. It is a further objective to provide a device for installing the commonly used edge covering binding tape to carpet base strips and then rolling said tape carrying strips into a roll all in a same single connected operation.

THE DRAWINGS

The best mode presently contemplated for carrying out the invention is illustrated in the accompanying drawings, in which:

FIG. 1 is a side elevation of a combined carpet strip edge tape sewing machine and carpet strip winding device in accordance with the invention;

FIG. 2, a fragmentary side elevation of the lower part of the combination of FIG. 1, showing the rolling machine control pedal and cable means at the tape sewing machine of the invention in a different position, with portions of the cable broken away;

FIG. 3, an end elevation of the carpet strip rolling device of the invention, taken along the line 3—3 of FIG. 1, drawn to a slightly larger scale than that of FIG. 1;

FIG. 4, a top plan view of the strip rolling device of FIG. 3, taken along the line 4—4 thereof;

FIG. 5, a fragmentary vertical section of the strip rolling device of FIG. 3, taken along the line 5—5 thereof;

FIG. 6, a fragmentary vertical section of the strip rolling device of FIG. 3, taken along the line 6—6 thereof, showing securement of the end of the carpet strip in the device;

FIG. 7, a fragmentary horizontal section of the strip rolling device of FIG. 3, taken along the line 7—7 thereof;

FIG. 8, a fragmentary horizontal section of the carpet strip rolling device of FIG. 3, taken along the line 8—8 thereof, drawn to a larger scale;

FIG. 9, a fragmentary side elevation of the carpet strip rolling device of FIG. 3, showing a frame mounted foot pedal for controlling the clutch lever of the spindle powering motor;

FIG. 10, a fragmentary vertical section of the spindle of the strip rolling device of FIG. 8, taken along the line 10—10 thereof;

FIG. 11, a fragmentary perspective view of the carpet strip winding device of FIG. 1, shown with the front and rear guiding discs assembled upon the spindle, the device having a roll of carpet strip wound thereon; and FIG. 12, a fragmentary exploded view of a portion of FIG. 11, showing the collar, front guiding disc and completed carpet strip roll as removed from the spindle.

DETAILED DESCRIPTION OF THE ILLUSTRATED EMBODIMENTS

Figure 1:
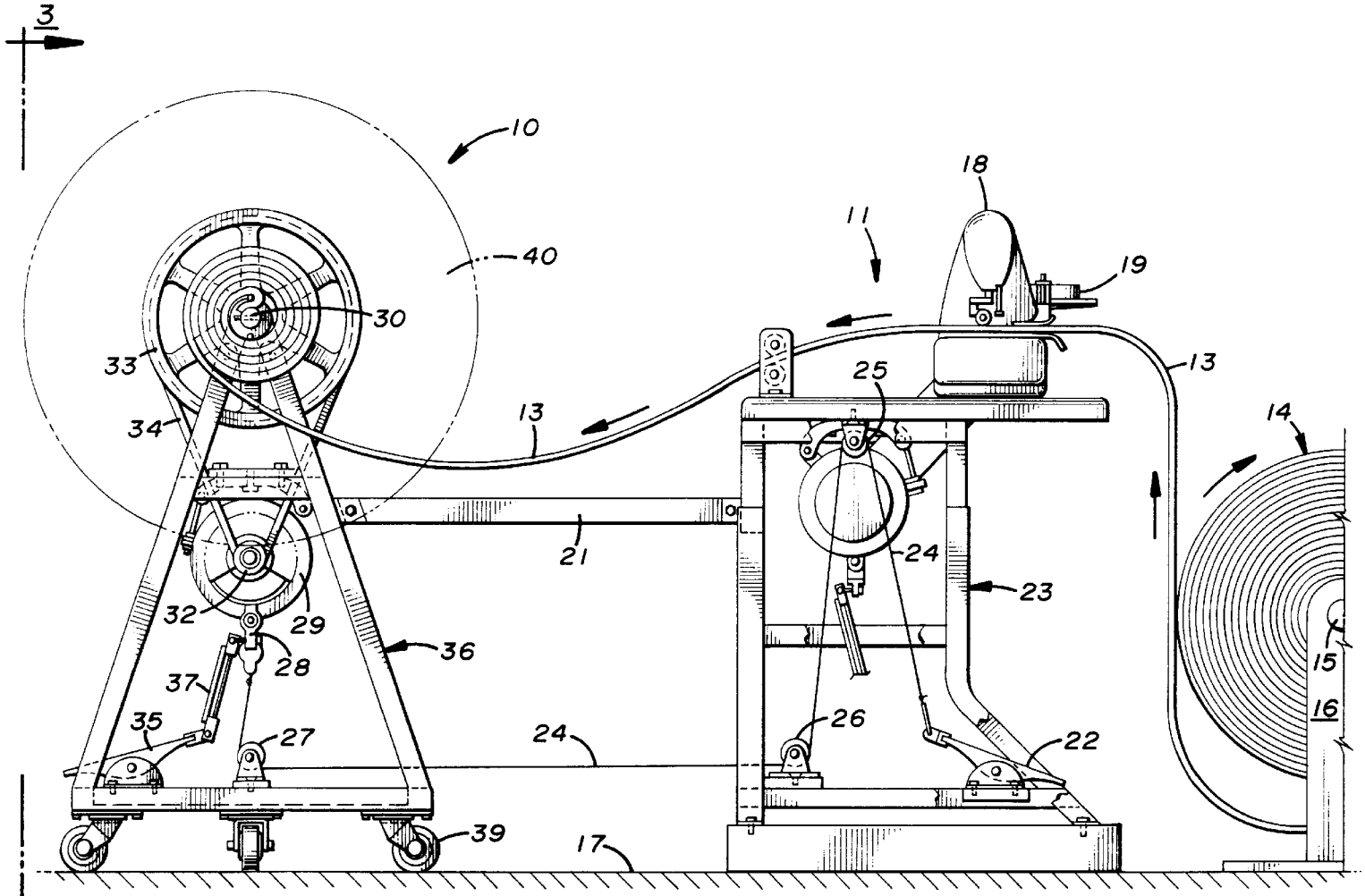
Figure 3:
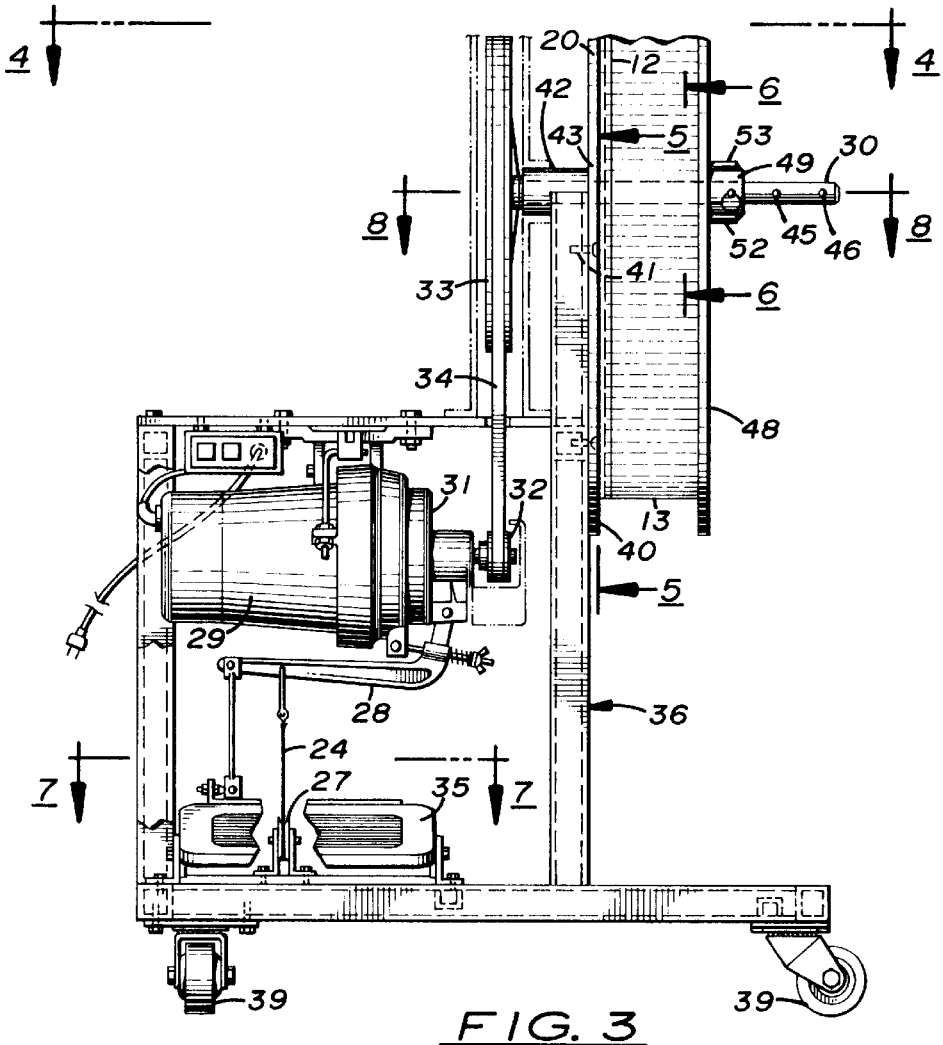
Figure 4:
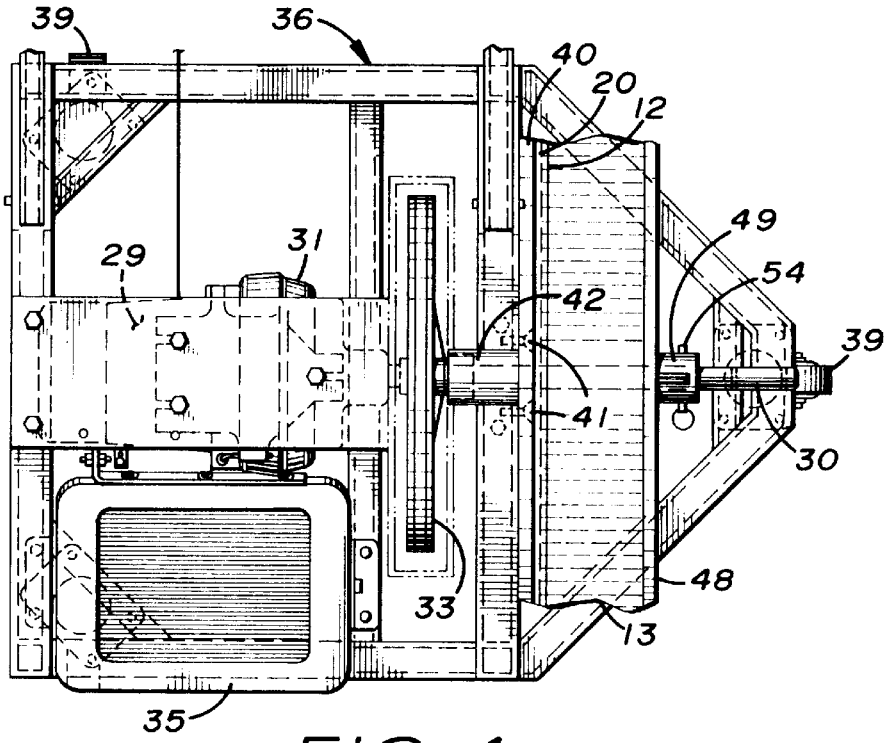
Figure 5:
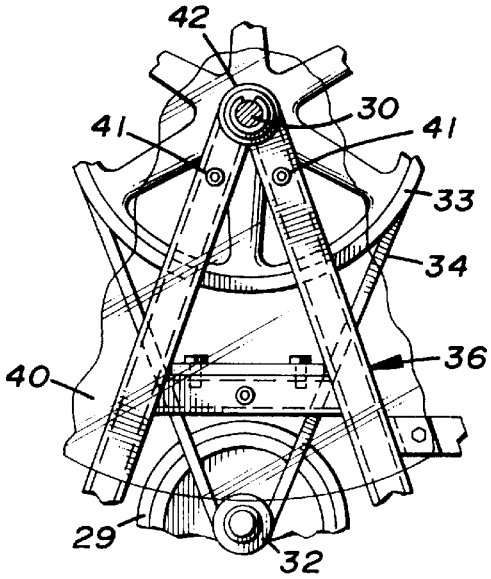
Figure 8:
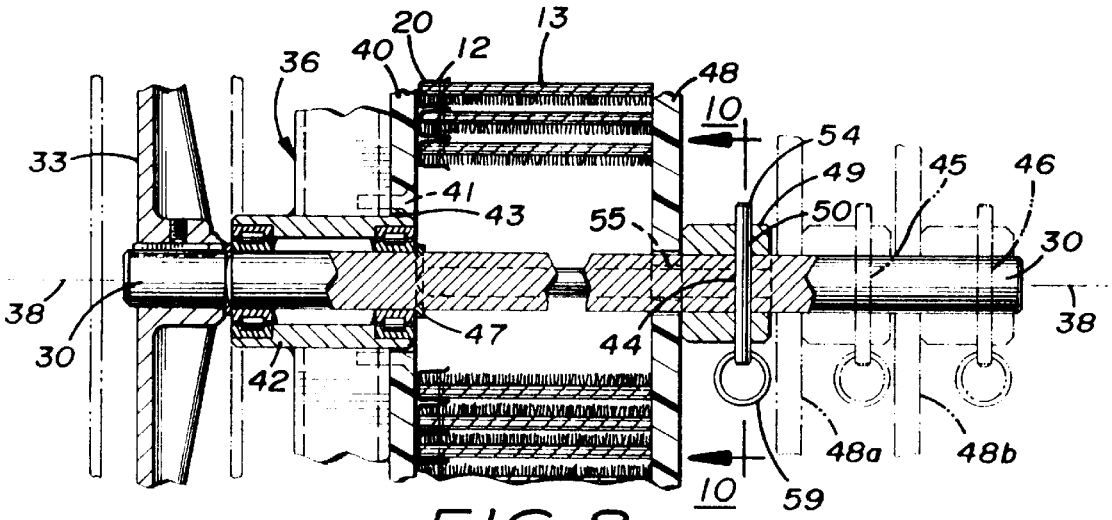
Figure 10:
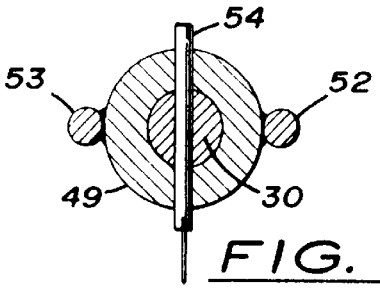
Figure 11:
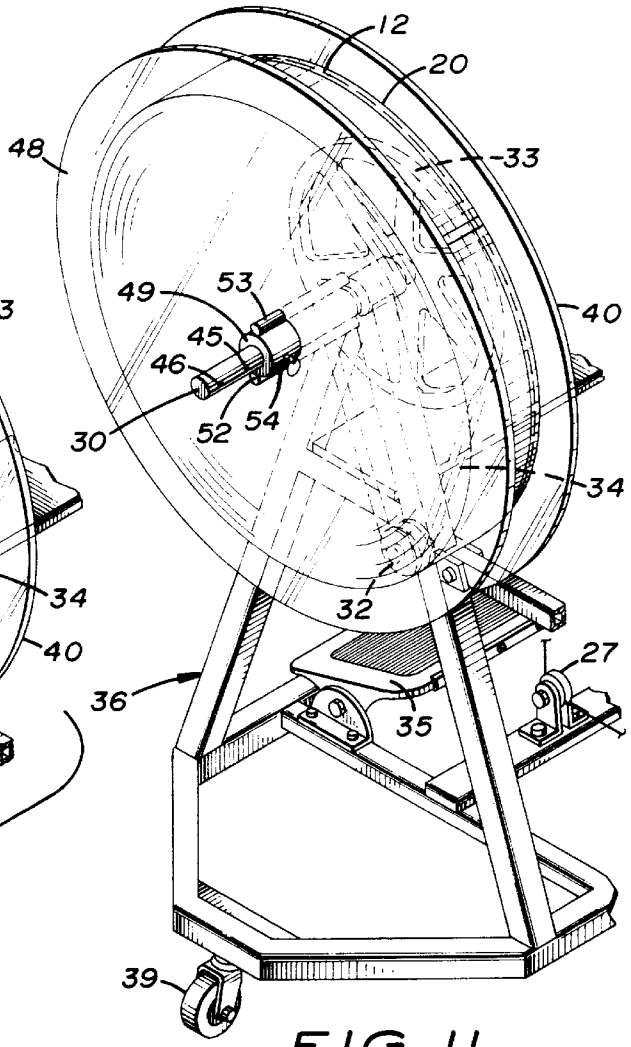

A carpet base strip rolling device 10 in accordance with the invention is illustrated in FIG. 1 being used in combination with a sewing device or station 11 used for sewing of a strip 12, FIGS. 3, 4, and 8, of binding fabric along one edge of the carpet base strip 13. A suitable sewing device is Union Special Catalog #112R, available from N-C Equipment Corporation of Newark, N.J. Equivalent sewing devices are also available. The carpet strip 13, previously cut from a roll of carpet, not shown, and rolled into a supply roll 14 as with the rolling device of the present invention, is advantageously supported by an axle 15 mounted in a stanchion 16. Alternately, carpet strip 13 may be supplied, hand guided from a pile, not shown, upon the shop floor 17. Carpet strip 13 is provided with the binding strip 12 by sewing machine 18. The sewing machine 18 of sewing station 11 typically feeds a roll 19 of binding tape through appropriate guiding devices, not shown, to fold around an edge 20 of carpet strip 13 and be sewn in place thereabout. This binding 12 is ultimately exposed uppermost on the carpet base strip 13 against the wall, and presents a finished appearance to the strip and prevents fraying of the uppermost edge.

Figure 2:
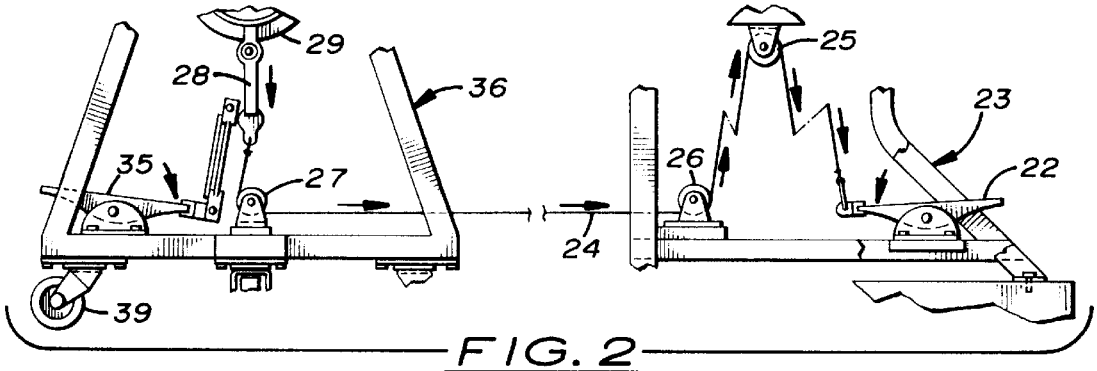
Figure 9:
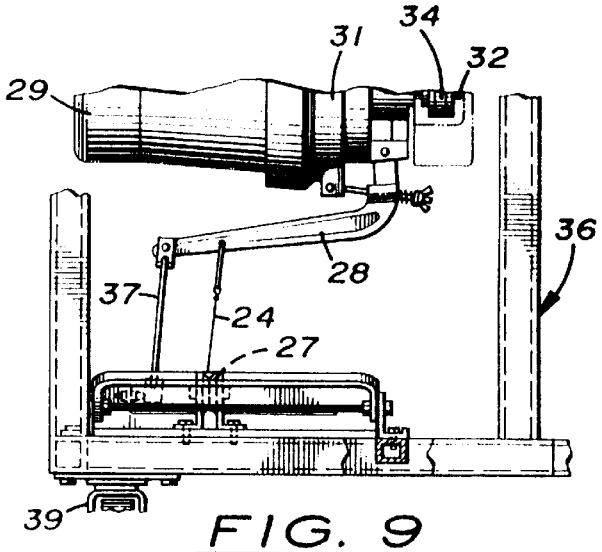

When carpet strip rolling device 10 is used in conjunction with sewing device or station 11, a positioning frame member 21 holds caster mounted carpet rolling device 10 properly positioned with respect to the floor-mounted sewing device 11. When used in combination, devices 10 and 11 are both controllable, by a single operator, from the frame of sewing device 11. Foot pedal 22 is mounted pivotally upon frame 23 of sewing device 11 and connects with a flexible wire cable 24 guided by pulleys 25 and 26, FIGS. 1 and 2, mounted on frame 23 of sewing device 11 and by pulley 27 mounted on frame 36 of carpet strip rolling device 10. The far end of cable 24 is connected to a lever 28 pivotally connected to a clutch device 31, FIGS. 3 and 9, connected to a motor 29 which powers a rotating spindle 30 about which carpet strip 13 is wound, FIGS. 1, 3, 5 and 12. Actuation of pedal 22 at sewing device 11 urges lever 28 downwardly. This engages the motor clutch 31 to cause motor 29, acting through pulleys 32 and 33 with belt 34, to rotate spindle 30 to wind carpet strip 13 thereabout. Clutch lever 28 may also be operated directly at carpet rolling device 10 by a second foot pedal 35, with linkage 37, on frame 36 of carpet rolling device 10. A suitable clutch motor 29 may be obtained from WMC Corporation of Newark, N.J. Equivalent clutch motors are also available from other sources. The speed of rotation of spindle 30 may be set by the relative sizes of pulleys 32 and 33, with pulley 33 being of larger diameter than pulley 32 so the spindle 30 rotates at a slower speed than does pulley 32. If a further reduction in speed is desired, an additional belt and set of pulleys may be added in known manner.

Strip rolling spindle 30 is supported upon rolling device frame 36, and is journaled to rotate about a horizontal axis 38. Frame 36 is advantageously supported by casters 39 to provide useful mobility when used apart from sewing station 11. A circular strip guiding disc 40 is fixedly secured to frame 36 as by screws 41, FIGS. 3, 5 and 12. Spindle 30 rotates within frame-mounted bearing 42, and extends through a central perforation 43, FIG. 8, in stationary frame mounted guiding disc 40.

As seen in FIGS. 3, 4 and 8, winding spindle 30 extends horizontally from back guiding disc 40. In the illustrated embodiment, this extending portion of spindle 30 is of circular rod formation and carries cross bores 44, 45 and 46. Circumferential snap ring 47, FIG. 8, prevents movement of spindle 30 axially through hole 43 in disc 40 and through bearing 42.

An outward or front disc 48 of equal diameter to disc 40 is, in preparation of strip winding, mounted on spindle 30. The location of front disc 48 is selected in accordance with the width of the carpet base strip 13 being rolled. The selective strip widths in the illustrated embodiment may be four, six, or eight inches as shown in FIG. 8, with the position of disc 48 in solid lines representing the position for a four inch strip and the alternate positions shown by 48*a* and 48*b* representing the positions for six and eight inches, respectively. A positioning collar 49 holds front disc 48 in position during rolling of strip 13. Collar 49 has a cross bore 50 which may be axially aligned with a selected one of the bores 44, 45, or 46 through spindle rod 30. A pin 54 with handle ring 59 is placed through the aligned bores, securing the collar 49 against both translation along and rotation about spindle 30. The pin includes a spring loaded ball 54*a*, FIG. 8, to removably lock pin 54 in position through collar 49 and spindle 30.

Figure 6:
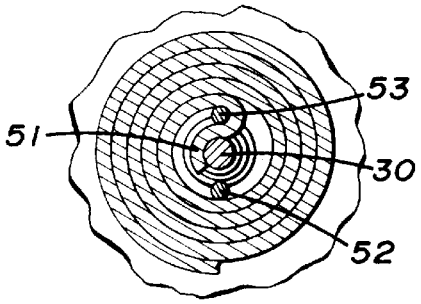
Figure 7:
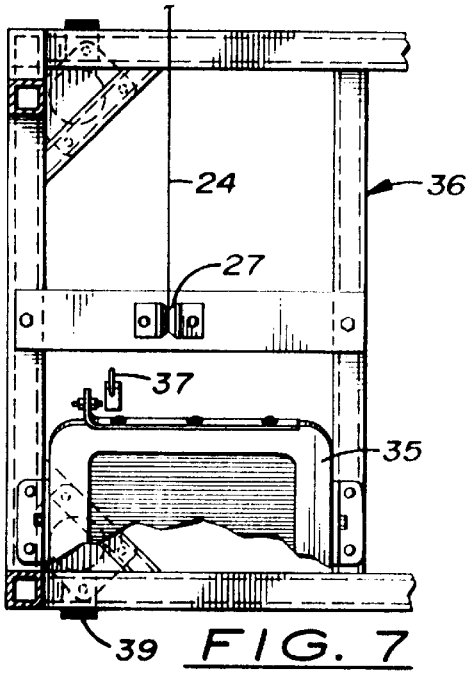

At the start of operation, front disc 48 is positioned about spindle 30 at the proper distance from rear disc 40 to accommodate the width of a strip being wound. However, the starting end 51 of strip 13 must be held by spindle 30 so that it can be rolled as the spindle rotates about its axis. Also, the completed roll must be easily removable from spindle 30. A pair of diametrically opposed horizontal rods 52 and 53, FIGS. 3, 6, and 10–12, are secured, as by welding, to positioning collar 49. A pair of radially opposed clearance holes 55 and 56 are provided in front disc 40, through which rods 52 and 53 extend spaced outwardly from the outside surface of spindle 30. To secure the starting end 51 of strip 13, said end is inserted through the space between spindle 30 and one of the rods. Upon subsequent rotation of spindle 30, the strip folds and is wound about said spindle as indicated in FIG. 6. This effectively secures the end of the strip to rotate with spindle 30 so that the carpet strip is rolled about spindle 30. Since the carpet is somewhat stiff, rods 52 and 53 can be spaced from spindle 30 more than the thickness of the carpet and still be effective to catch and hold the end of the carpet strip. Thus, the space between rods 52 and 53 and spindle 30 should be at least a little greater than the thickest carpet to be wound so an end of a carpet strip can be easily inserted between spindle 30 and either rod 52 or 53.

Figure 12:
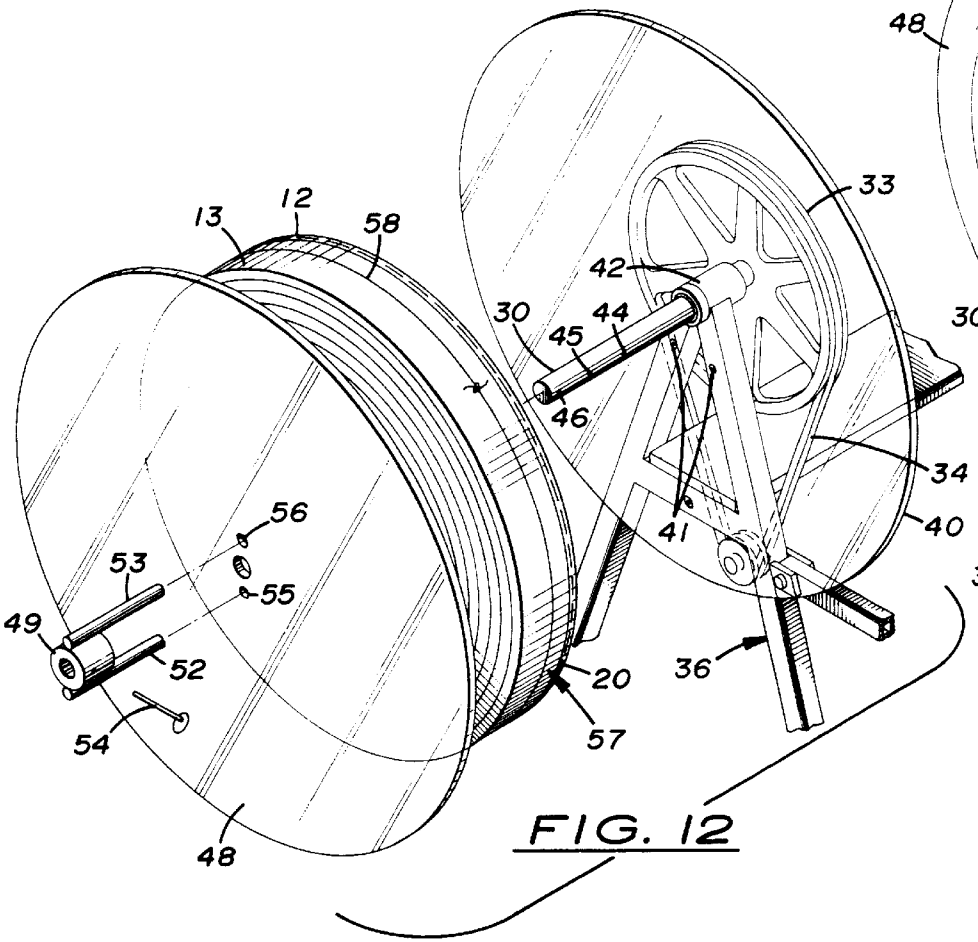

After strip 13 is rolled about spindle 30 producing a roll 57 of desired diameter, the roll is secured as with a length of string 58 or other binding material, such as tape, to maintain the carpet strip in a tight roll. The pin 54, collar 49 with rods 52 and 53, and outer disc 48 are removed as indicated in FIG. 12. Roll 57 is then loose on and can easily be pulled from spindle 30.

The rolling device 10 may vary from that illustrated and described without departing from the spirit of the invention. For example, the portion of the spindle extending outwardly from the stationary inner disc 40 could be of square, hex, or other form instead of the circular rod form illustrated. In such instance, pin 54 is not necessary as it has been found that outer disc 48 and collar 49 will substantially maintain their positions along spindle 30 during rolling and the principal purpose of pin 54 is to cause collar 49 to rotate with spindle 30 when the spindle is of circular rod formation. The device 10 can be used apart from the securing station to roll strips of carpet as cut from rolls prior to binding or to roll strips previously bound and provided to the rolling device by manual or means other than directly from the binding sewing device. The means providing controlled power to the spindle could be other than shown. The powering motor could be adapted to be controlled other than by a clutch, such as by control of the motor with a switch, rheostat, or electronic control. Selectable gear ratios could also be used.

Whereas this invention is here illustrated and described with reference to embodiments thereof presently contemplated as the best mode of carrying out such invention in actual practice, it is to be understood that various changes may be made in adapting the invention to different embodiments without departing from the broader inventive concepts disclosed herein and comprehended by the claims that follow.

I claim:

1. A device for winding an elongate strip of flexible material into a roll without using a spool, said device comprising:

a frame;

an elongate, fixedly-mounted cantilevered spindle mounted upon the frame journaled to rotate about an elongate axis of said spindle;

means powering the spindle to rotate about the elongate axis;

combination means for attaching the starting end of the strip to the spindle, guiding the winding of said strip onto the spindle as it rotates, and releasing the attached starting end of the wound strip from the spindle without removing the resulting wound roll of strip from said spindle and while maintaining the shape of the roll of the strip for subsequent removal from the spindle.

2. The flexible strip rolling device of claim 1, wherein the means powering the spindle includes an electric motor the power output therefrom rotating the spindle.

3. The flexible strip rolling device of claim 2 wherein the combination means includes a circular back disc having a hole therethrough to pass the spindle and which back disk is mounted to the frame concentrically with the spindle, said back disk having an outwardly facing planar surface substantially perpendicular to the axis of the spindle to guide the strip during winding of a roll thereof.

4. The flexible strip rolling device of claim 3, wherein the combination means further includes a circular front disc having a hole therethrough to pass the spindle, such front disk being positioned about the spindle concentric therewith spaced outwardly from the back disc and means to releasable secure the front disc to the spindle, the front disc having an inwardly facing planar surface substantially perpendicular to the axis of the spindle which contacts the roll to maintain the shape thereof while releasing the attached starting end of the strip from the spindle following rolling thereof.

5. The flexible strip rolling device of claim 4, wherein the means to releasibly secure the front disc comprises a collar slidable along the spindle and securable thereto at a plurality of fixed distances from the back disc so as to accommodate strips of multiple widths.

6. The flexible strip rolling device of claim 5, wherein the combination means further comprises at least one elongate rigid rod fixedly secured to the collar and extending longitudinally from said collar parallel to and outwardly radially spaced from the spindle a distance sufficient for insertion of the starting end of the strip between said rod and said spindle, said rod which extends through a hole in the front disc into the space between the back and front disks.

7. The flexible strip rolling device of claim 6, wherein:

the motor includes clutching means acting between a power output shaft of the motor and a pulley and belt means rotating the spindle;

the motor carries a pivotally attached external lever, the rotation of which engages and disengages the clutching means; and the position of the lever is controlled by the operator using a foot pedal.

8. The flexible strip rolling device of claim 7, further including a sewing machine device for sewing a covering of fringe tape about one edge of a flexible strip in the form of carpet being fed therethrough to form a carpet base strip, which sewing machine device is rigidly attached to the strip rolling device, the strip rolling device accepting the strip from the sewing machine device and winding the strip into a roll about the spindle.

9. The flexible strip rolling device of claim 6, further including a sewing machine device for sewing a covering of fringe tape about one edge of a flexible strip in the form of carpet being fed therethrough to form a carpet base strip, which sewing machine device is rigidly attached to the strip rolling device, the strip rolling device accepting the strip from the sewing machine device and winding the strip into a roll about the spindle.

10. The flexible strip rolling device of claim 4, wherein:

the motor includes clutching means acting between a power output shaft of the motor and a pulley and belt means rotating the spindle;

the motor carries a pivotally attached external lever, the rotation of which engages and disengages the clutching means; and the position of the lever is controlled by the operator using a foot pedal.

11. A device for producing a roll of carpet base strip, said device comprising:

a sewing machine device for sewing a covering of fringe tape about one edge of a strip of carpet being fed therethrough to form a carpet base strip, the sewing machine device being controllable by means of a foot pedal mounted thereto;

a carpet strip rolling device fixedly secured by means of a frame member to the sewing machine device for receiving the strip from said machine to produce a roll thereof without using a spool, the carpet strip rolling device being controllable by means of a foot pedal mounted thereto; and wherein the foot pedal of the sewing machine device is mechanically connected to the foot pedal of the carpet strip rolling device by means of a cable and a plurality of pulleys such that both the sewing machine and carpet strip rolling devices are controllable by a single operator at the sewing machine device.

12. The carpet base strip producing device of claim 11, wherein the carpet strip rolling device comprises:

a frame;

an elongate, fixedly-mounted cantilevered spindle mounted upon the frame journaled to rotate about an elongate axis of said spindle;

means powering the spindle to rotate about the elongate axis which means is controllable using the foot pedal;

combination means for attaching the starting end of the strip to the spindle, guiding the winding of said strip onto the spindle as it rotates, and releasing the attached starting end of the wound strip from the spindle without removing the resulting roll of strip from said spindle and while maintaining the shape of the roll of strip for subsequent removal from the spindle.

13. The flexible strip rolling device of claim 12, wherein the means powering the spindle includes an electric motor the power output therefrom rotating the spindle and being controllable using the foot pedal.

14. The flexible strip rolling device of claim 13, wherein the combination means includes a circular back disc having a hole therethrough to pass the spindle and which back disk is mounted to the frame concentrically with the spindle, said back disk having an outwardly facing planar surface substantially perpendicular to the axis of the spindle to guide the strip during winding of a roll thereof.

15. The flexible strip rolling device of claim 14, wherein the combination means further includes a circular front disc having a hole therethrough to pass the spindle, such front disk being positioned about the spindle concentric therewith spaced outwardly from the back disc and means to releasibly secure the front disc to the spindle, the front disc having an inwardly facing planar surface substantially perpendicular to the axis of the spindle which contacts the roll to maintain the shape thereof while releasing the attached starting end of the strip from the spindle following rolling thereof.

16. The flexible strip rolling device of claim 15, wherein the means to releasibly secure the front disc comprises a collar slidable along the spindle and securable thereto at a plurality of fixed distances from the back disc so as to accommodate strips of multiple widths.

17. The flexible strip rolling device of claim 16, wherein the combination means further comprises at least one elongate rigid rod fixedly secured to the collar and extending longitudinally from said collar parallel to and outwardly radially spaced from the spindle a distance sufficient for insertion of the starting end of the strip between said rod and said spindle, said rod which extends through a hole in the front disc into the space between the back and front discs.

18. The flexible strip rolling device of claim 17, wherein:

the motor includes clutching means acting between a power output shaft of the motor and a pulley and belt means rotating the spindle;

the motor carries a pivotally attached external lever, the rotation of which engages and disengages the clutching means; and the position of the lever is controlled by the operator using the foot pedal.

19. A device for attaching the starting end of a strip of flexible material to an elongate fixedly-mounted cantilevered spindle mounted upon a frame and journaled to rotate about an elongate axis of the spindle and for guiding the winding of the strip onto the spindle then releasing the resulting roll of wound strip for removal from the spindle, the device comprising:

a collar which is slidable along and which is releasable securable to the spindle;

an elongate rigid rod affixed to said collar and extending longitudinally therefrom parallel to and outwardly radially spaced from the spindle a distance sufficient for insertion of the starting end of the strip between said rod and the spindle;

a front disc which includes a first hole therethrough to pass the spindle and a second hole which is outwardly radially spaced from said first hole such a distance and which is of such a size as to pass said rod when said disc and said collar are assembled to the spindle; and wherein following winding of a roll of the strip, said disc can be held in place against the roll and the roll stripped from said rod by removing said collar with attached rod from said shaft to free the starting end of the strip while maintaining the shape of the roll which remains on the spindle for subsequent removal.

20. The attaching device of claim 19, wherein the collar is releasable securable to the spindle at a plurality of fixed distances from the back disk so as to accommodate multiple widths of material.

21. The attaching device of claim 19, further comprising a second elongate rigid rod affixed to the collar radially opposite the first rod and extending longitudinally from said collar parallel to and outwardly radially spaced from the spindle a distance sufficient for insertion of the starting end of the strip between said second rod and said spindle.

22. The attaching device of claim 19, wherein the collar is removably affixed to the free end of the spindle by means of a pin which extends through respective coaxial holes through the collar and the free end of the spindle.

* * * * *